US009261277B2

(12) United States Patent
Hugghins et al.

(10) Patent No.: US 9,261,277 B2
(45) Date of Patent: Feb. 16, 2016

(54) INDUCER SPEED CONTROL METHOD FOR COMBUSTION FURNACE

(75) Inventors: Gordon Jeffrey Hugghins, Jacksonville, TX (US); Stephen Kowalski, Tyler, TX (US); Robert G. Roycroft, Whitehouse, TX (US)

(73) Assignee: Trane International Inc., Piscataway, NJ (US)

( * ) Notice: Subject to any disclaimer, the term of this patent is extended or adjusted under 35 U.S.C. 154(b) by 2469 days.

(21) Appl. No.: 11/893,242

(22) Filed: Aug. 15, 2007

(65) Prior Publication Data

US 2009/0044794 A1 Feb. 19, 2009

(51) Int. Cl.

| | |
|---|---|
| ***F24H 9/20*** | (2006.01) |
| ***F23N 3/00*** | (2006.01) |
| ***F23N 3/08*** | (2006.01) |
| ***F23N 5/24*** | (2006.01) |
| ***F24H 3/08*** | (2006.01) |

(52) U.S. Cl.

CPC ..... *F23N 3/002* (2013.01); *F23N 3/082* (2013.01); *F23N 5/242* (2013.01); *F24H 3/087* (2013.01); *F24H 9/2085* (2013.01); *F23N 3/005* (2013.01); *F23N 2023/46* (2013.01); *F23N 2025/06* (2013.01); *F23N 2033/04* (2013.01); *F23N 2037/10* (2013.01); *F23N 2041/06* (2013.01)

(58) Field of Classification Search

USPC ..... 126/116 A

See application file for complete search history.

(56) References Cited

U.S. PATENT DOCUMENTS

| | | | | |
|---|---|---|---|---|
| 4,251,025 | A | 2/1981 | Bonne et al. | |
| 4,729,207 | A | 3/1988 | Dempsey et al. | |
| 4,842,190 | A * | 6/1989 | Orchard | 236/11 |
| 5,248,083 | A * | 9/1993 | Adams et al. | 236/11 |
| 5,271,556 | A * | 12/1993 | Helt et al. | 236/11 |
| 5,331,944 | A * | 7/1994 | Kujawa et al. | 126/110 R |
| 5,340,028 | A * | 8/1994 | Thompson | 236/10 |
| 5,418,438 | A | 5/1995 | Hollenbeck | |
| 5,557,182 | A | 9/1996 | Hollenbeck et al. | |
| 5,616,995 | A | 4/1997 | Hollenbeck | |

(Continued)

*Primary Examiner* — Steven B McAllister
*Assistant Examiner* — Frances F Hamilton
(74) *Attorney, Agent, or Firm* — Conley Rose, P.C.; J. Robert Brown, Jr.; Michael J. Schofield

(57) ABSTRACT

In a multistage combustion furnace having a motor driven inducer blower and a pressure sensing device or set of switches for sensing pressure in the combustion gas flowpath through the furnace, a high firing rate blower speed and low firing rate blower speed are set based on the blower speed setting required for a medium firing rate. Each particular furnace, having its own pressures and combustion gas resistance to flow characteristics, may be provided with a database of inducer blower motor speeds required to achieve predetermined pressures in the combustion gas flowpath for a variety of combustion gas venting systems generating such resistance.

16 Claims, 3 Drawing Sheets

(56) References Cited

U.S. PATENT DOCUMENTS

| | | | | |
|---|---|---|---|---|
| 5,680,021 | A | 10/1997 | Hollenbeck | |
| 5,682,826 | A * | 11/1997 | Hollenbeck | 110/147 |
| 5,732,691 | A * | 3/1998 | Maiello et al. | 126/116 A |
| 5,791,332 | A | 8/1998 | Thompson et al. | |
| 5,957,064 | A * | 9/1999 | Barry et al. | 110/188 |
| 6,161,535 | A * | 12/2000 | Dempsey et al. | 126/110 R |
| 6,257,870 | B1 | 7/2001 | Hugghins et al. | |
| 6,321,744 | B1 * | 11/2001 | Dempsey et al. | 126/116 A |
| 6,377,426 | B2 * | 4/2002 | Hugghins et al. | 361/23 |
| 7,101,172 | B2 * | 9/2006 | Jaeschke | 431/19 |
| 7,293,718 | B2 * | 11/2007 | Sigafus et al. | 236/11 |
| 7,320,362 | B2 * | 1/2008 | Nichols | 165/205 |
| 2008/0073440 | A1 * | 3/2008 | Butler et al. | 236/91 R |
| 2008/0124667 | A1 * | 5/2008 | Schultz | 431/18 |
| 2008/0127962 | A1 * | 6/2008 | Thompson | 126/116 A |
| 2008/0127963 | A1 * | 6/2008 | Thompson | F23N 1/062 126/116 A |

* cited by examiner

INDUCER SPEED CONTROL METHOD FOR COMBUSTION FURNACE

BACKGROUND OF THE INVENTION

Efficient combustion furnaces for heating, ventilating and air conditioning (HVAC) equipment applications are typically provided with a motor driven so-called ventilating or inducer blower which draws air through the combustion passageways of the furnace heat exchanger to improve the efficiency of the combustion and heat transfer processes and to prolong the life of the furnace. Selection of the proper speeds of the inducer blower drive motor for multistage combustion furnaces, in particular, has been a somewhat nettlesome problem. Combustion furnaces which include electronic controls have been developed wherein the inducer blower motor speed is controlled based on opening and closing of pressure switches which measure the pressures developed by the inducer blower at one or more particular points in the air flowpath.

Moreover, so-called learning algorithms have been developed which require setting a blower default speed for multistage furnaces for the low firing rate and high firing rate which is the first speed that the inducer motor will be controlled to when a call for the low firing rate or high firing rate is signaled to the furnace controller. The inducer blower then "learns" a speed based on opening and closing of the pressure switches. Still further, typically, a low speed limit is defined in the control system program to avoid the combustion gas control valve closing prematurely. U.S. Pat. Nos. 6,257,870 and 6,377,426 to Hugghins, et al. and assigned to the assignee of the present invention disclose and claim methods for setting inducer blower operating speeds.

However, for multistage furnaces including, for example, three stage furnaces, it is desirable to maintain the inducer flow pressures above a predetermined setpoint which is particularly important at low firing rates to avoid low combustion gas pressures which could create undesirable combustion characteristics. This occurs because the gas valve output pressure tracks the inducer or system pressures in the aforementioned type of furnace. Still further, it is desirable to simplify the "learning" of the inducer blower motor speeds for respective furnace firing rates in multistage furnaces, including three stage furnaces. In accordance with the present invention, improvements in determining and setting inducer blower speeds and operating pressures have been realized and attendant advantages enjoyed as a result.

SUMMARY OF THE INVENTION

The present invention provides an improved method of determining proper inducer or ventilating blower speeds for multistage combustion furnaces for HVAC applications In accordance with one aspect of the present invention, a method of controlling the inducer or ventilating blower speed and the pressures generated thereby has been developed wherein a control system for the furnace is programmed to provide, initially, a default speed for a medium or intermediate furnace firing rate, for example. A learn routine is provided for the medium firing rate and a multiple of the learned medium firing rate inducer blower speed value is applied to set a blower motor speed for a low firing rate and a high firing rate based on the speed at the medium or intermediate firing rate. These multiples may be based on the realization that there is a substantially linear relationship between properly set inducer blower speed and the flow resistance caused by the venting system connected to the furnace. Thus, the lower inducer blower speed limits and upper speed limits can be defined by this relationship and set as multiples of the learned medium or intermediate firing rate inducer blower speed. Inducer blower speeds determined in this manner allow for proper furnace operation with virtually any type of venting system normally expected to be connected to the furnace.

In accordance with another aspect of the present invention there is provided a method of controlling a combustion furnace, including a multistage furnace and, particularly, a three-stage furnace wherein the furnace control system learns a medium speed for the inducer blower motor to which is applied a multiple or multiplier (less than one and greater than one) to provide inducer blower speeds for a furnace low firing rate and a high firing rate. The multiplier may be different for different models of furnace, but may be provided to the control system for a particular furnace when it leaves the point of manufacture or at a later time. Accordingly, a learning procedure for the inducer blower motor speed at low firing rates and high firing rates is not required and the so-called target inducer blower speeds for low and high firing rates are actually relatively closer to a learned speed than arbitrarily selected default speeds.

In accordance with a further aspect of the present invention a method of determining inducer blower speeds is provided wherein one or more inducer blower speeds for particular firing rates of a furnace may be preset and based on respective multiples or multipliers of another selected motor speed and which multiples may be developed through testing the flow resistance of various lengths and configurations of furnace venting systems likely to be applied to respective different furnace models. The multipliers would possibly be different for different furnace models and could be provided to a particular furnace control system as part of a set of control and operating parameters programmed in the control system directly or on a separate information or "personality" module associated with the furnace prior to or after shipment from the point of manufacture.

Still further, the invention contemplates the provision of a furnace control system and method of operation wherein only a single pressure switch or pressure sensor would be required to properly operate the furnace at different inducer blower speeds.

Those skilled in the art will further appreciate the above-mentioned advantages and superior features of the invention, together with other important aspects thereof, upon reading the detailed description which follows in conjunction with the drawings.

DETAILED DESCRIPTION OF A PREFERRED EMBODIMENT

Figure 1:
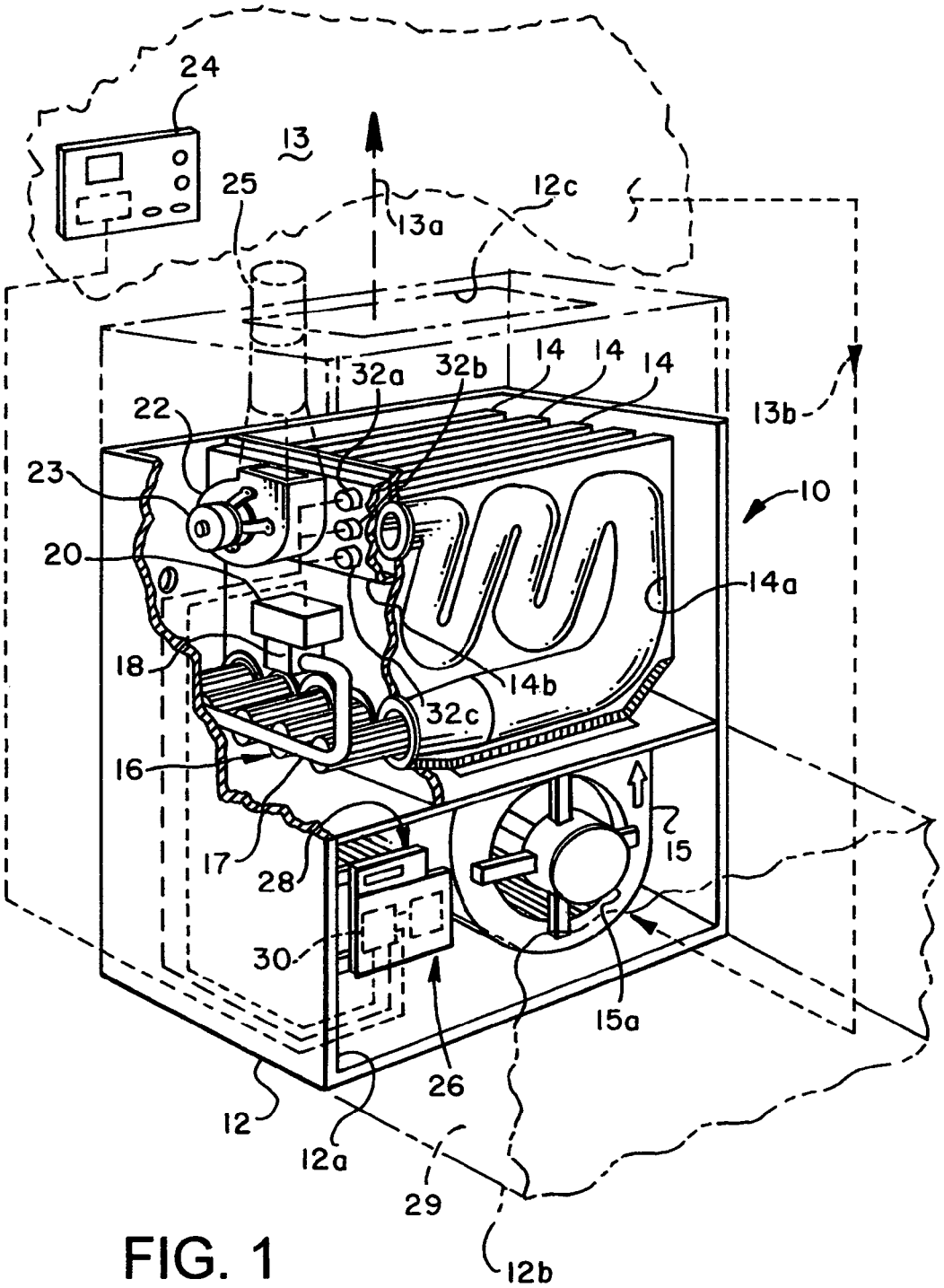
FIG. 1 is a perspective view, in somewhat schematic form, of a multistage combustion furnace operable in accordance with the method of the present invention.

In the description which follows like elements are marked through the specification and drawing with the same reference numerals, respectively. The drawing figures are not necessarily to scale and certain elements are shown in schematic or somewhat generalized form in the interest of clarity and conciseness.

Referring to FIG. 1, there is illustrated a combustion furnace operable by the method of the present invention and generally designated by the numeral 10. The furnace 10 is illustrated as including a generally rectangular boxlike cabinet 12 having an air inlet opening 12*a* adapted to be connected to a return air duct 12*b*. Cabinet 12 also includes a discharge air opening 12*c* for discharging air through suitable ducting to an enclosed space 13. Airflow to and from the furnace 10 is via suitable ducting and in accordance with the direction of flow indicated by the arrows 13*a* and 13*b*. Combustion furnace 10 includes plural side-by-side gaseous fuel fired heat exchangers 14, each being provided with a serpentine combustion gas flow passage 14*a*, one shown, and each discharging combustion gases and ventilation air to a plenum 14*b* in a known manner. Additional details of combustion gas furnaces of the general type referred to herein are described in U.S. Pat. No. 5,060,722 to Zdenek, et al. and U.S. Pat. No. 5,309,892 to Lawlor, et al., both of which are assigned to the assignee of the present invention.

Air circulated to and from the space 13 is propelled through cabinet 12 by a motor driven air circulation blower 15 disposed within the cabinet, as illustrated in FIG. 1. Combustion fuel is delivered to the heat exchangers 14 at respective burners 16 which are supplied with fuel, such as natural gas, by way of a manifold 17 connected to a control valve 18 having a suitable electric controller 20 associated therewith. An electric motor driven inducer or ventilating blower 22 is operably associated with the plenum 14*b* for drawing air and combustion gases through the heat exchangers 14 in a known manner. Blower 22 is controlled by an electric drive motor 23 which includes a suitable speed control system to be described in further detail herein. A temperature sensor or so-called thermostat 24 is disposed in the space 13 and is operably connected to a furnace control system 26 disposed at the cabinet 12.

Control system 26 may include an interface 28 for use by a user or service technician for setting certain control parameters and observing certain operating conditions of furnace 10. Control system 26 includes, for example, a microcontroller 30 for receiving signals from the thermostat 24 and for controlling operation of the blowers 15 and 22 and the fuel flow control valve 18. Suitable pressure sensors or switches, three shown by way of example, are designated by numerals 32*a*, 32*b* and 32*c* in FIG. 1 and are shown mounted on plenum 14*b* for sensing the pressure therein. The pressure sensors 32*a*, 32*b* and 32*c* may be characterized as pressure switches which open and close at fixed or adjustable preset pressures and are suitably disposed within the flow path of the combustion gases and air being circulated by the blower 22. Other locations of the sensors or switches 32*a*, 32*b* and 32*c* may be selected as compared with the location illustrated. Moreover, the switches or sensors 32*a*, 32*b* and 32*c* may be replaced by a single variable pressure sensor which is operable to output signals to the control system 26, indicating the pressure associated with the air and combustion products flowstream flowing through the heat exchangers 14.

Combustion products discharged from the furnace 10 are conducted through a vent system or flue pipe 25 suitably connected to the blower 22 and normally having a length sufficient to conduct combustion gases to the exterior of the structure or building in which the furnace 10 is located. Accordingly, the so-called venting system, including the flue pipe 25, may be of various lengths and configurations and may include one or more pipe elements which are curved. Thus, a certain resistance to flow of combustion products would be associated with the configuration of a particular venting system. Accordingly, each furnace design or configuration, including its venting system, would have a set of inducer blower motor speeds corresponding to furnace and venting system flow characteristics and required to produce desired pressures and flow rates through the heat exchanger passages 14*a* and plenum 14*b*. Of course, the pressures that the inducer blower 22 is capable of producing in the combustion gas flowpath, including the burner or heat exchanger passages 14*a* and the plenum 14*b*, will vary with the speed of the blower and its drive motor 23.

Figure 2:
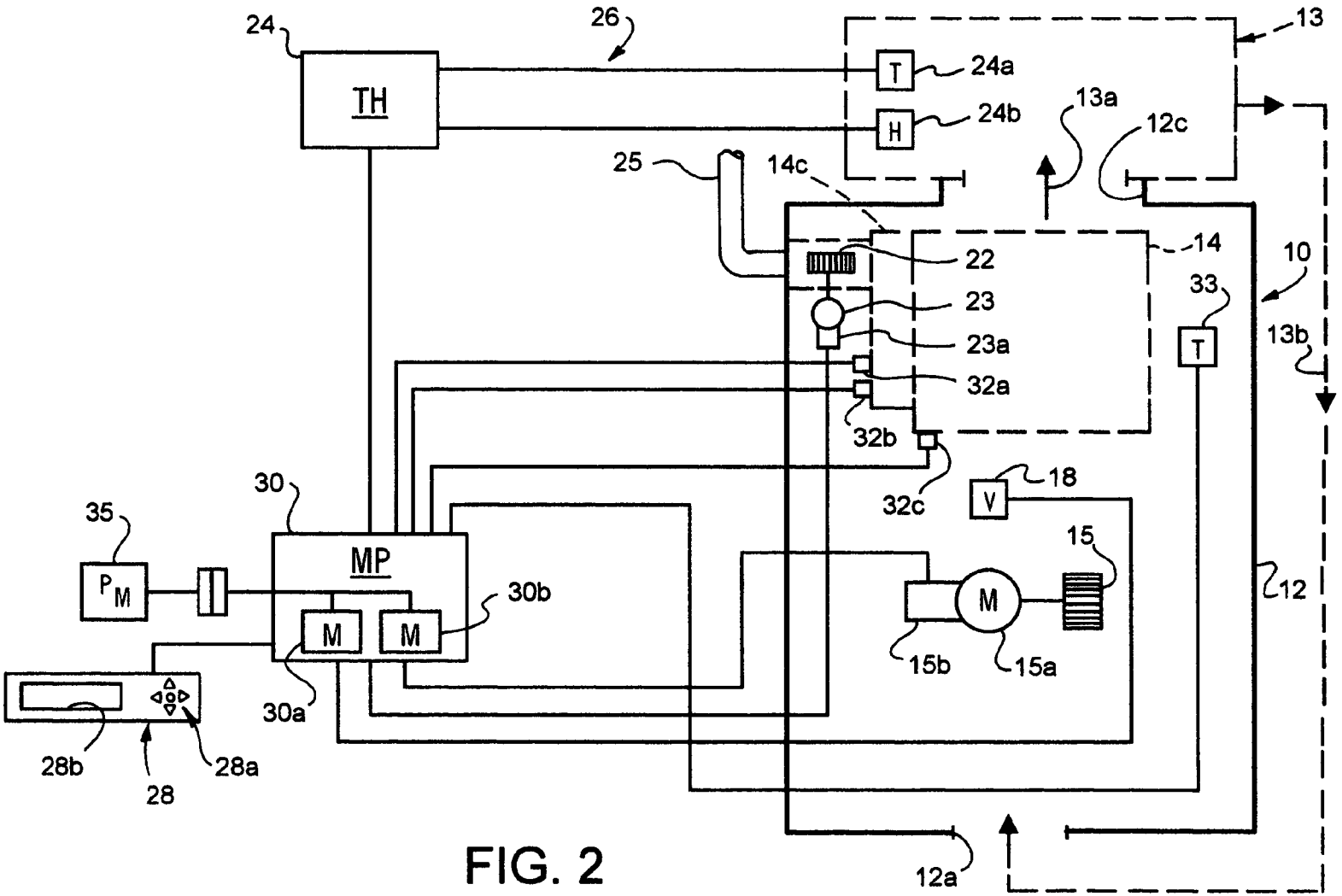
FIG. 2 is a schematic diagram of a control system for the furnace illustrated in FIG. 1.

Referring now to FIG. 2, there is illustrated a schematic diagram of control system 26 which includes a microprocessor 30 operable to receive signals from the thermostat 24 and the pressure switches 32*a*, 32*b* and 32*c*, as well as a limit temperature sensor or switch 33 disposed in cabinet 12. Microprocessor 30 is operable to control the operation of motor 15*a* by way of a motor control circuit 15*b*, the operation of valve 18 and the operation of inducer blower motor 23 by way of its own speed control circuit 23*a*. User interface 28 may be used to observe certain operating parameters of the control system 26 and make selections of such parameters via a suitable user operable keypad 28*a* and a visual display 28*b*. Still further, microprocessor 30 may include certain memory circuits 30*a* and 30*b* which are operable to receive information from a separate circuit of a device 35 which may be releasably connected to the microprocessor 30 and sometimes referred to as a so-called personality module. The personality module 35 may be of a type described in co-pending U.S. patent application Ser. No. 11/717,466 filed Mar. 13, 2007, by Robert W. Helt, et al. and assigned to the assignee of the present invention. Still further, thermostat 24 includes, for example, temperature and humidity sensors 24*a* and 24*b* disposed within the space 13 whereby thermostat 24 is operable to communicate signals to the microprocessor 30 to initiate operation of the furnace 10 under a so-called "call for heat" signal, such operation being well-known to those skilled in the art.

For a particular furnace design and capacity for a three-stage furnace, for example, blower motor speeds for driving blower 22 sufficient to provide required pressures generated by the blower may be predetermined. Moreover, for various configurations of the furnace combustion products venting system, including the vent conduit or pipe 25, for a particular furnace design, the blower speeds for motor 23 may also be determined and which are sufficient to generate the required pressures. With respect to determining pressures, such pressures are normally measured as negative (below atmospheric pressure) in inches of water column. Hence, a high pressure is actually a greater amount of vacuum being pulled by the blower 22 within the plenum 14*c* or otherwise within the flowpath of ventilation air and combustion gases proceeding through the heat exchangers 14. Since it has been determined there is a linear relationship between the required inducer blower speed for a predetermined amount of pressure generated by the blower 22 and the length or configuration of the vent system, including the vent conduit or pipe 25, a low furnace firing rate speed required of the blower 22 for generating a low firing rate pressure may be determined and the low firing rate speed is related to the medium firing rate speed required of the blower 22 for providing the required pressures at the medium firing rate. Moreover, if a learned medium firing rate inducer blower speed is obtained, then a relationship between the medium firing rate blower speed and the low firing rate blower speed may also be calculated, since it is a multiple of the learned medium firing rate blower speed. Accordingly, by basing the low firing rate inducer blower speed on a learned medium firing rate inducer blower speed which has been learned for a particular furnace installation, a multiplier may be applied to the learned medium speed value to determine the low firing rate speed of the blower 22. Still further, since the position of the control valve 18 and the fuel gas pressure in manifold 17 is correlated with the pressure produced by the blower 22 within the furnace 10, unreasonably low manifold pressures which could create undesirable combustion characteristics are avoided.

In addition to establishing a low firing rate speed of blower 22 and pressures within the heat exchangers 14 produced thereby, the linear relationship between inducer blower speed and the configuration of the vent system, such as the conduit 25, provides for determining the speed of blower motor 23 to produce suitable pressures in the furnace 10 commensurate with a high furnace firing rate and based on the learned medium firing rate blower speed. Moreover, the relationship between the required pressures generated by the blower 22 for a particular firing rate, such as a medium firing rate, and the blower motor speed required to obtain such pressures, may be used to set the inducer blower speeds and attendant pressures for a continuously variable firing rate, based on a table of blower speeds versus vent system effective length for the vent system or conduit 25. This data can be furnished from the module 35 and input to the processor 30 for a particular furnace 10, as previously mentioned.

Figure 3:
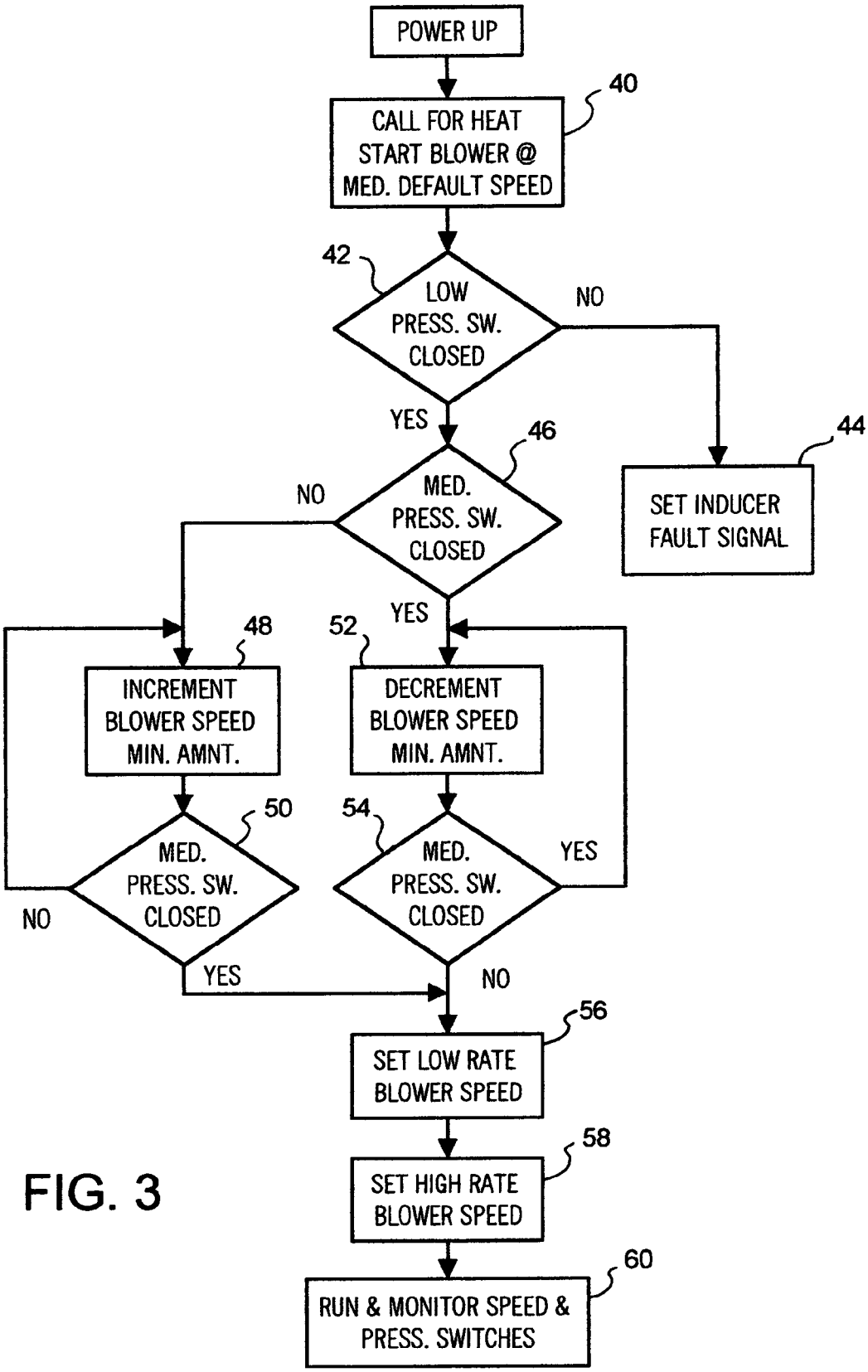
FIG. 3 is a flow diagram illustrating certain steps in the method of the present invention.

One preferred method of setting the respective speeds for the inducer blower 22 is indicated in FIG. 3. At "power-up" or start, when a call for heat is received at step 40, blower motor 23 is set to operate at a predetermined medium firing rate default speed and a low speed (low firing rate) pressure switch position is checked at step 42. If the low firing rate pressure switch is not closed, if such a switch is being used, a fault signal is set by control system 26 at step 44. If the low firing rate pressure switch is closed, then the medium firing rate pressure switch is checked at step 46. If the medium firing rate pressure switch is not closed, the blower motor 23 speed is incremented a predetermined minimum amount at step 48 and a status of the medium firing rate pressure switch is checked again at step 50.

If, at step 50, the medium firing rate pressure switch is not closed, steps 48 and 50 are repeated until the switch is closed. If the medium firing rate pressure switch is closed at step 46, the process proceeds to step 52 and the speed of blower motor 23 is decremented a minimum predetermined amount and the status of the medium firing rate pressure switch is checked again at step 54. Steps 52 and 54 are repeated until the medium firing rate pressure switch opens. Accordingly, within a relatively narrow range of pressure conditions for the furnace medium or intermediate firing rate, a suitable speed for blower 22 is established and monitored by the processor 30 via the motor control circuit 23*a*. Once the medium firing rate blower motor speed for blower 22 is established the control system 26 will query the database stored in memories 30*a* and/or 30*b* to set the low firing rate blower speed for blower motor 23 at step 56 and then the process may proceed to set the high firing rate speed for blower motor 23 at step 58. The furnace 10 then will continue to run at step 60 while blower motor speed for blower 22 is monitored together with monitoring of the pressure switches 32*a*, 32*b* and 32*c*.

Alternatively, the control system 26 may utilize a pressure sensor in place of plural pressure switches, which sensor continuously monitors pressures in a selected location or locations of the ventilating air and combustion gas flowpath through heat exchangers 14. The pressure settings at which action is taken may be carried out by the control system 26 by monitoring the pressure signal input from such a sensor to the microprocessor 30. For example, the medium firing rate speed of blower 22 could be set based on a limited range of suitable pressures for the medium firing rate. Blower speeds could be incremented or decremented from the aforementioned medium firing rate default speed until the pressure sensed by such a pressure sensor was within the predetermined range.

Still further, the present invention contemplates that a single pressure switch may be used to set the medium firing rate blower motor speed for blower 22 followed by the steps indicated in FIG. 3. In other words, steps 42 and 44 would be eliminated from the process shown in FIG. 3 and, at a call for heat, control over the blower 22 would immediately proceed from the medium default speed to the medium learned speed based on the process of FIG. 3 to establish a pressure within the furnace combustion system suitable for the specified firing rate, and the low and high firing rate blower speeds would then be determined in accordance with the process shown in FIG. 3.

Those skilled in the art will recognize that an improved process and system for operating a multistage combustion furnace of the so-called inducer or ventilating type is provided by the present invention. Conventional engineering materials, components and procedures may be carried out to practice the invention. Although a preferred embodiment has been described in detail herein, those skilled in the art will also recognize that various substitutions and modifications may be made without departing from the scope and spirit of the appended claims.

What is claimed is:

1. A method for operating a multistage combustion furnace, said combustion furnace including a heat exchanger including at least one combustion gas flowpath, an inducer blower for inducing the flow of air and combustion gases through said flowpath, for discharging combustion gases to a vent conduit, a blower motor drivably connected to said blower, pressure sensing means for sensing the pressure within the combustion gas flowpath at a predetermined location, a combustion fuel control valve and a control system including a microprocessor operably connected to said control valve, said blower motor, said pressure sensing means and to a thermostat for receiving signals for a call for heat for a space serviced by said furnace, said method comprising:

starting said combustion furnace at a first firing rate in response to a call for heat by said thermostat;

starting said blower motor at a predetermined speed for said first firing rate;

learning a blower speed for said first firing rate, wherein the blower speed at which said pressure sensing means is actuated is the learned blower speed for said first firing rate; and determining a blower speed for said blower for a different firing rate based on the learned blower speed for said first firing rate.

2. The method set forth in claim 1 wherein:

said blower speed at said different firing rate is determined as a multiple of said learned blower speed for said first firing rate.

3. The method set forth in claim 1 wherein:

said learned blower speed for said first firing rate is learned by selectively incrementing and decrementing said blower from said predetermined blower speed.

4. The method set forth in claim 1 including the step of:

setting a blower speed at second and third speeds for respective second and third firing rates, each of the second and third speeds being based on the learned blower speed for said first firing rate.

5. The method set forth in claim 4 wherein:

said first firing rate is a medium firing rate of said furnace and said second blower speed corresponds to a low firing rate of said furnace.

6. The method set forth in claim 4 including the step of:

said first firing rate is a medium firing rate and said third blower speed corresponds to a high firing rate of said furnace.

7. The method set forth in claim 1 including the step of:

providing values of blower speed required to overcome combustion gas flow resistance of a venting system for said furnace to generate predetermined pressures in said furnace.

8. The method set forth in claim 1 wherein:

said pressure sensing means comprises plural pressure sensing switches including at least a low firing rate pressure switch and a medium firing rate pressure switch; and generating a fault signal for said furnace, if at furnace startup, said low firing rate pressure switch does not close.

9. A method for operating a multistage combustion furnace, said combustion furnace including a heat exchanger including at least one combustion gas flowpath, an inducer blower for inducing the flow of air and combustion gases through said flowpath, for discharging combustion gases to a vent conduit, a blower motor drivably connected to said blower, pressure sensing means for sensing the pressure within the combustion gas flowpath at a predetermined location, a combustion fuel control valve and a control system including a microprocessor operably connected to said control valve, said blower motor, said pressure sensing means and to a thermostat for receiving signals for a call for heat for a space serviced by said furnace, said method comprising:

starting said combustion furnace at an intermediate firing rate in response to a call for heat by said thermostat;

starting said blower at a predetermined speed for said intermediate firing rate;

learning a blower speed for said intermediate firing rate, wherein the blower speed at which said pressure sensing means is actuated is the learned blower speed for said intermediate firing rate; and determining a blower speed for said blower for a different firing rate based on a multiplier applied to the blower speed learned for said intermediate firing rate.

10. The method set forth in claim 9 including the steps of:

selectively incrementing and decrementing said predetermined blower speed to learn the learned blower speed for said intermediate firing rate.

11. The method set forth in claim 10 including the step of:

setting second and third blower speeds for respective low and high firing rates based on the learned blower speed for said intermediate firing rate.

12. The method set forth in claim 9 including the step of:

providing values of blower speed required to overcome combustion gas flow resistance of a venting system for said furnace to generate predetermined pressures in said furnace and basing said blower speed for said intermediate firing rate and said multipliers on said values of blower speeds required to overcome said flow resistance.

13. The method set forth in claim 9 wherein:

said pressure sensing means comprises plural pressure sensing switches including at least a low firing rate pressure switch and an intermediate firing rate pressure switch; and generating a fault signal for said furnace, if at furnace startup, said low firing rate pressure switch does not close.

14. A method for operating a three stage combustion furnace, said combustion furnace including a heat exchanger including at least one combustion gas flowpath, an inducer blower for inducing the flow of air and combustion gases through said flowpath, for discharging combustion gases to a vent conduit, a blower motor drivably connected to said blower, pressure sensing means for sensing the pressure within the combustion gas flowpath at a predetermined location, a combustion fuel control valve and a control system including a microprocessor operably connected to said control valve, said blower motor, said pressure sensing means and to a thermostat for receiving signals for a call for heat for a space serviced by said furnace, said method comprising:

starting said combustion furnace at a first firing rate in response to a call for heat by said thermostat;

operating said blower motor at a first blower speed for said first firing rate;

learning a blower speed for said first firing rate, wherein the blower speed at which said pressure sensing means is actuated is the learned blower speed for said first firing rate; and determining second and third blower speeds for said blower for second and third firing rates based on said learned blower speed.

15. The method set forth in claim 14 including the steps of:

selectively incrementing and decrementing said first blower speed to learn the learned blower speed for said first firing rate prior to determining said second and third blower speeds.

16. The method set forth in claim 14 including the step of:

providing values of blower speeds required to overcome combustion gas flow resistance of a venting system for said furnace to generate predetermined pressures in said furnace for said respective firing rates.

* * * * *